United States Patent [19]

Matsuda et al.

[11] 4,074,398

[45] * Feb. 21, 1978

[54] SLIDE FASTENER TAPE

[75] Inventors: Yoshio Matsuda, Nyuzen; Yoshitoki Tsubokawa, Kurobe, both of Japan

[73] Assignee: Yoshida Kogyo Kabushiki Kaisha, Japan

[ * ] Notice: The portion of the term of this patent subsequent to Apr. 5, 1994, has been disclaimed.

[21] Appl. No.: 613,997

[22] Filed: Sept. 17, 1975

[30] Foreign Application Priority Data

Sept. 27, 1974 Japan ..... 49-117522

[51] Int. Cl.[2] ..... A44B 19/12

[52] U.S. Cl. ..... 24/205.1 C; 24/205.16 C; 66/195

[58] Field of Search ..... 24/205.16 R, 205.16 C, 24/205.1 C, 205.13 C; 66/195

[56] References Cited

U.S. PATENT DOCUMENTS

| | | | |
|---|---|---|---|
| 3,714,683 | 2/1973 | Frohlich et al. | 24/205.16 C |
| 3,849,842 | 11/1974 | Yoshida | 24/205.16 C |
| 3,922,760 | 12/1975 | Matsuda | 24/205.16 C |
| 3,974,550 | 8/1976 | Fujisaki et al. | 66/195 |

*Primary Examiner*—Paul R. Gilliam
*Assistant Examiner*—Kenneth J. Dorner
*Attorney, Agent, or Firm*—Bucknam and Archer

[57] ABSTRACT

A stringer tape for slide fastener has a warp-knit structure including longitudinally extending alternate wales and interwale grooves. Those wales lying adjacent and behind respective edge portions of the tape are formed with fewer knitting threads than at the remaining wales and arranged substantially in symmetrical positions.

3 Claims, 4 Drawing Figures

SLIDE FASTENER TAPE

BACKGROUND OF THE INVENTION

This invention relates to slide fasteners, particularly to stringer tapes therefor.

There have been proposed numerous forms of stringer tapes for supporting thereon interlocking fastener elements. Modern types of such stringer tapes include warp-knit fabric tapes having at least on one surface a multiplicity of alternate wales and interwale grooves. It is to this type of stringer tape for a slide fastener which the invention is directed.

Most prior-art warp-knit tapes were subtantially uniform in the structural details over and throughout the entire areas. When attaching slide fasteners having such uniformly knitted tapes onto garment fabrics, particularly onto both front and back flies at a time, it was difficult to sew the fastener along a proper line of stitching unless measures were taken to indicate exactly where the sewing needle should pass.

SUMMARY OF THE INVENTION

It is therefore the primary object of the present invention to provide fastener tapes having an improved warp-knit structure whereby the fastener can be sewn onto both front and back flies of a garment where desired and along the correct line of stitching without the necessity of any added procedures.

Briefly stated, this object can be achieved by a slide fastener tape of a warp-knit structure having alternate wales and interwale grooves, which tape includes longitudinally extending opposite edge portions adapted for mounting thereon a row of fastener elements characterized in that selected wales lying adjacent and behind the respective edge portions are formed with fewer knitting threads than those at the remaining wales.

The invention will be better understood from the following detailed description taken in conjunction with the accompanying drawings illustrating a preferred embodiment which the invention may assume in practice.

DESCRIPTION OF THE PREFERRED EMBODIMENTS

Figure 1:
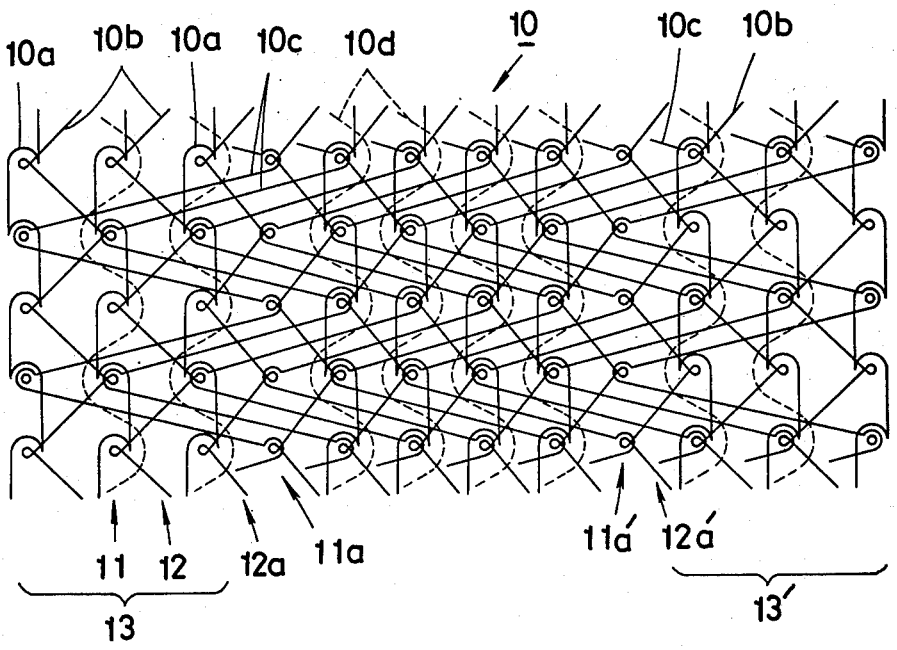
FIG. 1 is a diagram schematically illustrating a warp-knit structure which is employed for the purpose of the invention.

Referring now to the drawings and FIG. 1 in particular, there is shown a preferred warp-knit structure provided in accordance with the invention. A tape 10 of this structure generally comprises chain stitches 10*a* forming a majority of longitudinally extending wales, tricot stitches 10*b* in the lay 1-2/1-0, stitches 10*c* in the lay 0-1/4-3 and reinforcing warp threads 10*d*.

Figure 2:
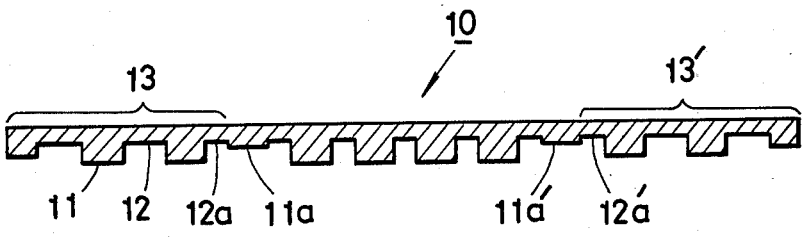
FIG. 2 is a transverse cross-sectional view of a tape having the warp-knit structure of FIG. 1.

The tape 10 thus when observed in its transverse cross section presents on one surface a multiplicity of alternate wales 11 and interwale grooves 12 as shown in FIG. 2.

Designated at 13 or 13' is a longitudinal edge portion adapted for mounting thereon a row of interlocking fastener elements E (FIG. 3) which are shown for purposes of illustration to be in the form of a continuous, helically coiled structure.

According to an important aspect of the invention, there are provided reduced or thinned wales 11*a* and 11*a'* preferably symmetrically or substantially symmetrically at predetermined positions adjacent and behind the opposite element-mounting edge portions 13 and 13', respectively. The reduced or thinned wales 11*a*, 11*a'* are each formed solely with 1-2/1-0 tricot stitches 10*b* and 0-1/4-3 stitches 10*c*; that is, in the absence of chain stitches 10*a* and warp threads 10*d*, so that the loop density of the resulting wales 11*a*, 11*a'* is considerably reduced as compared to the remaining wales 11 of the tape 10 and hence rendered relatively thin and flexible.

In the embodiment illustrated in FIG. 2, the reduced wales 11*a* and 11*a'* are located immediately adjacent to element-mounting edge portions 13 and 13',respectively, or at the fourth of wales counting from the extremities of respective longitudinal edges of the tape 10. The position of each of the reduced, flexible wales 11*a* and 11*a'* however depends upon the size of fastener element to be employed for a given slide fastener. While it is preferred to arrange these selected wales in symmetrical positions on the tape 10 such as seen in FIG. 2, either of them may be shifted somewhat out of symmetry relative to the other depending upon the manner of sewing the fastener to a given garment, as shown in FIG. 4.

Figure 3:
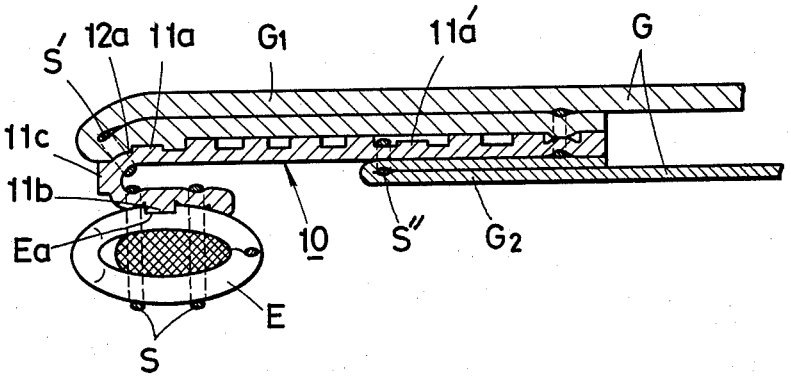
FIG. 3 is a transverse cross-sectional view of the same shown as applied to a concealed or masked type of slide fastener and attached to the front and back flies of a garment.

FIG. 3 shows the warp-knit stringer tape 10 of the invention as applied to a concealed or masked type of slide fastener, in which the coil element E is secured by sewn stitches S to the element-mounting edge portion 13 with the second wale 11*b* anchored in a recess E*a* formed in the element E. The element-mounting edge portion 13 (13') is folded on itself and secured by sewm stitches S' to a front fly $G_1$ of a garment G at and along an interwale groove 12*a* between the third wale 11*c* and the reduced fourth wale 11*a*. The tape 10 is further sewn by stitches S'' to a back fly $G_2$ at and along an interwale groove adjoining the other reduced wale 11*a'*.

Figure 4:
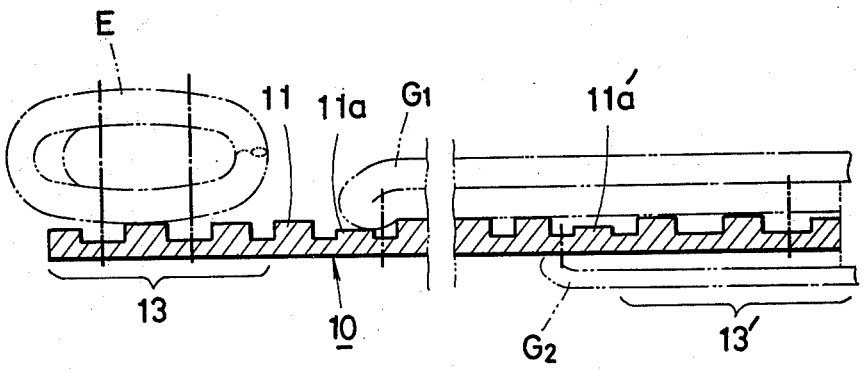
FIG. 4 is a transverse cross-sectional view of the tape shown as applied to a standard type of slide fastener.

FIG. 4 shows the warp-knit stringer tape 10 as applied to a standard type of slide fastener, in which instance the element E is mounted on the waled side of the tape 10 as contrasted to the embodiment of FIG. 3. The tape 10 is conveniently sewn adjacent the reduced wales 11*a* and 11*a'* respectively to the front and back flies $G_1$ and $G_2$ of the garment G. It will be appreciated that the reduced wales 11*a* and 11*a'* being deformed as compared to the remaining wales 11 can each serve as a guide line for the passage of a sewing needle not shown, whereby the fastener can be sewn properly into position on the garment as desired.

Having thus described the invention, it will be understood that the warp-knit fastener tape 10 constructed in accordance with the invention can be accurately and neatly sewn where desired onto both front and back flies of a garment. Another advantage is that since the particular wales 11*a* and 11*a'* are formed with fewer knitting threads than those at the remaining wales and located substantially in symmetrical positions behind the respective element-mounting edge portions 13, 13' of the tape 10, the feeding of such stringer tape for the attachment thereon of fastener elements in the course of manufacture of slide fasteners can be performed most expeditiously without having to pay particular attention to which way to direct the tape. Still another advantage is that being symmetrically knitted, the tapes 10 can be placed in storage most easily without having to sort out the left-hand half from the right-hand half of tape.

What is claimed is:

1. In a slide fastener stringer tape having a warp-knit structure with alternate wales and interwale grooves, the improvement comprising chain stitches, tricot stitches, warp threads and additional stitches transversely spanning a plurality of wales, defining in the tape a web portion and at least one marginal edge portion adjoining said web portion, said marginal edge portion having a wale of lesser height than the other wales of such marginal edge portion, said wale of lesser height being constituted solely by some of said tricot stitches and some of said additional stitches and defining a guide path for sewing stitches.

2. The improvement according to claim 1 including a pair of said marginal edge portions each adjoining said web portion on an opposite side thereof, the wale of lesser height on one marginal edge portion defining a guide path for sewing stitches securing a row of fastener elements to the tape, and the wale of lesser height on the other marginal edge portion defining a guide path for sewing stitches securing the tape to a support means.

3. The improvement according to claim 1 wherein said tricot stitches have a lay 1-2/1-0 and said additional stitches have a lay 0-1/4-3.

* * * * *